US009782010B1

(12) United States Patent
Bodden-Burdick

(10) Patent No.: US 9,782,010 B1
(45) Date of Patent: Oct. 10, 2017

(54) CABANA HAVING AN ADJUSTABLE FOLDING HOOD

(71) Applicant: Barbara Bodden-Burdick, Orlando, FL (US)

(72) Inventor: Barbara Bodden-Burdick, Orlando, FL (US)

(73) Assignee: AMERICAN HOLTZKRAFT, INC., Mt. Pleasant Mills, PA (US)

( * ) Notice: Subject to any disclaimer, the term of this patent is extended or adjusted under 35 U.S.C. 154(b) by 0 days.

(21) Appl. No.: 15/330,073

(22) Filed: Aug. 1, 2016

(51) Int. Cl.

| | |
|---|---|
| ***A47C 7/66*** | (2006.01) |
| ***E04H 15/02*** | (2006.01) |
| ***E04H 15/00*** | (2006.01) |
| ***E04H 15/54*** | (2006.01) |
| ***E04H 15/48*** | (2006.01) |
| ***E04H 15/40*** | (2006.01) |
| ***A47C 1/14*** | (2006.01) |
| ***A47C 1/022*** | (2006.01) |

(52) U.S. Cl.
CPC ..... *A47C 7/66* (2013.01); *A47C 1/022* (2013.01); *A47C 1/143* (2013.01); *E04H 15/005* (2013.01); *E04H 15/02* (2013.01); *E04H 15/405* (2013.01); *E04H 15/48* (2013.01); *E04H 15/54* (2013.01)

(58) Field of Classification Search
CPC ..... A47C 7/66; A47C 1/14; E04H 15/005; E04H 15/02; E04H 15/003; E04H 15/38
See application file for complete search history.

(56) References Cited

U.S. PATENT DOCUMENTS

| | | | | |
|---|---|---|---|---|
| 2,853,088 A | | 9/1958 | Lamborn | |
| 2,934,976 A | | 5/1960 | Fluke | |
| 3,431,923 A | | 3/1969 | Klepac | |
| 4,870,984 A | * | 10/1989 | Roth | A47C 15/004 135/148 |
| 5,015,032 A | * | 5/1991 | Felling | A47C 1/0242 297/184.15 |
| 5,320,405 A | | 6/1994 | Foster et al. | |
| 5,833,310 A | * | 11/1998 | Labelle | A47C 7/66 135/96 |

(Continued)

FOREIGN PATENT DOCUMENTS

| | | | | |
|---|---|---|---|---|
| CA | 2182991 C | * | 3/2005 | A47C 7/66 |
| NL | EP 2098663 A2 | * | 9/2009 | A47C 1/14 |

OTHER PUBLICATIONS http://www.hayneedle.com/product/fiberbuiltbeachpoolcabana.cfm?ltype=child&tid=FIB001-7 "Fiber Built Sunbrella Pool and Beach Cabana" sold by Hayneedle.

*Primary Examiner* — Noah Chandler Hawk
(74) *Attorney, Agent, or Firm* — Thomas R. Shaffer

(57) ABSTRACT

An adjustable folding cabana having a frame with legs is disclosed. A seat is supported on said frame. A front support member, a rear support member and an intermediate support member support a cabana fabric roof. The front support member is movable between a rear support position, an intermediate support position and a front support position. A guide rail is attached to the frame beneath said seat which has a front stop, an intermediate stop and a rear stop. Manipulating a control rod causes a cabana fabric hood to be fully extended when the rod is secured in the front stop, to be partially collapsed when the rod is secured in the intermediate stop, and to be fully collapsed when the rod is secured in the rear stop.

19 Claims, 9 Drawing Sheets

(56) References Cited

U.S. PATENT DOCUMENTS

| | | | | |
|---|---|---|---|---|
| 6,095,172 | A * | 8/2000 | Trapp | A47C 1/143<br>135/128 |
| 7,118,172 | B1 * | 10/2006 | Pattison-Sheets | A45F 4/02<br>224/155 |
| 7,591,032 | B2 * | 9/2009 | Harrison | A47C 1/14<br>135/96 |
| 8,292,362 | B2 | 10/2012 | Reeb et al. | |
| 9,574,367 | B2 * | 2/2017 | Hatfield | E04H 15/48 |
| 2009/0039685 | A1 * | 2/2009 | Zernov | A47C 7/66<br>297/16.2 |
| 2012/0012144 | A1 | 1/2012 | Cebular | |
| 2016/0362906 | A1 * | 12/2016 | Farris | E04H 15/58 |

* cited by examiner

CABANA HAVING AN ADJUSTABLE FOLDING HOOD

BACKGROUND OF THE INVENTION

1. Field of the Invention

The present invention relates to an adjustable folding cabana. More specifically, it relates to a folding cabana which has a fabric hood which can be selectively placed in a fully extended full shade position, a partially collapsed partial shade position or a fully collapsed no shade position.

2. Description of the Prior Art

The concept of providing a folding cabana is well known. Lamborn, U.S. Pat. No. 2,853,088 and Fluke, U.S. Pat. No. 2,934,976 disclose an early version of folding cabanas which includes a complex frame which can be secured in a fully open hood position or a fully collapsed position.

Another, simpler style of folding cabana is shown by Klepac, U.S. Pat. No. 3,431,923 which also has only a fully open or fully closed position.

It is also known to place a folding canopy directly onto a chair as disclosed by Reeb et al, U.S. Pat. No. 8,292,362; Foster et al., U.S. Pat. No. 5,320,405 and Cebular, U.S. Patent Application Pub. No. 2012/0012144 A1. These devices also appear to only have an open or collapsed position and only provide shade for the head of a user.

Commercially available folding cabanas are also know such as the "Fiber Built Sunbrella Pool and Beach Cabana" sold by Hayneedle found at: http://www.hayneedle.com/product/fiberbuiltbeachpoolcabana.cfm?ltype=child&tid=FIB001-7 While such a device does provide the shade of a full sized cabana, it also appears to only have a fully open or fully closed position. Further, this device, like many known devices are made from thin tubular lightweight frames which are difficult to secure from wind, especially high gusts of the type often found on beaches near an ocean or other large body of water. Further, because of the lightweight design, while such devices are easy to transport and set up, they can are also be quickly and easily collapsed and stolen even by a single person without a vehicle.

There remains a need for a collapsible cabana which has a heavy frame to make it semi-permanent to withstand heavy wind gusts without the need for special anchoring.

There remains a need for a collapsible cabana which has a heavy frame to make it semi-permanent to prevent theft of the cabana or of personal items stored in a lock box secured to the cabana.

There remains a need for a collapsible cabana which has an adjustable fabric hood which can be fully extended to a full shade position, partially collapsed to one or more partial shade positions or completely collapsed to a no shade, full sun position.

SUMMARY OF THE INVENTION

In its simplest form an adjustable folding cabana is provided which includes:

a) a frame having legs attached to said frame to support said frame in an elevated horizontal position;

b) a seat supported on said frame;

c) a front support member, a rear support member and at least one intermediate support member, said front support member and said at least one intermediate support member each having legs mounted for rotation at a connection point on said frame;

d) a cabana fabric hood having a rear hood end attached to said rear support member, a front hood end attached to said front support member and a middle hood portion attached to said at least one intermediate support member;

d) a guide rail attached to said frame beneath said seat and having a front stop, at least one intermediate stop and a rear stop;

e) a control rod adapted to slide on said guide rail and adjustably secured to one of said stops, said rod having at least one upright rod portion pivotally attached to said front support member whereby manipulating said control rod causes said cabana fabric to be fully extended when said rod is secured in said front stop, to be partially collapsed when said rod is secured one of said at least one intermediate stops, and to be fully collapsed when said rod is secured in said rear stop.

Causing the cabana fabric hood to be fully extended creates a full shade position with said front support member in said front support position, said at least one intermediate support member in said at least one intermediate support position and said rear support member in a said rear support position.

Causing the cabana fabric hood to be partially collapsed creates a partial shade position with said front support member and said at least one intermediate support member in said at least one intermediate support position and said rear support member is in a said rear support position.

Causing the cabana fabric hood to be fully collapsed creates a no shade position with said front support member, said at least one intermediate support member and rear support member all in said rear support position.

In one embodiment of the invention, said frame is generally rectangular in shape and has an inner frame to support one seat.

Preferably, said frame is generally rectangular in shape and has a modified inner frame to support two spaced-apart seats.

Preferably, a lockable storage cabinet is strongly secured between said two spaced-apart seats.

Preferably, said storage cabinet has a pivoting lid attached with dampening hinges to prevent injury from the lid rapidly closing.

Preferably, said at least one intermediate support member comprises a first intermediate support member and said at least one intermediate support position comprises a first intermediate support position.

Preferably, said at least one intermediate support member comprises a first intermediate support member and a second intermediate support member and said at least one intermediate support position comprises a first intermediate support position and a second intermediate support position.

In one embodiment of the invention, said seat comprises a cloth or plastic material stretched between side members of said frame.

Preferably, said seat comprises a hard bottom cushion supported between side members of said frame.

Preferably, said seat further comprises an adjustable back rest which can be locked into a plurality of positions between a fully flat position and a fully upright sitting position.

Preferably, said rear support member is said frame.

Preferably, said fabric support members can have any two dimensional shape having an open bottom and having downwardly depending leg portions to act as an arch or roof support for said cabana fabric.

Preferably, said support members have a general bottom open shape selected from the group comprising a square, rectangle, a triangle, a pentagon, a hexagon, an octagon, a circle, an oval, an inverted "U" and an arch.

Preferably, said stops are in the form of a groove cut into said guide rail at selected locations.

In one embodiment of the invention, stops are in the form of blocks attached to an upper surface of said guide rail at selected locations.

Preferably, said cabana fabric is water resistant and provides protection from ultraviolet rays from the sun.

Preferably, said frame is made of natural wood, synthetic wood or plastic.

These and other features and benefits of the present invention will be more fully described and shown in the figures and detailed description of the preferred embodiments of the invention which follow.

DETAILED DESCRIPTION OF THE PREFERRED EMBODIMENTS

Figure 1:
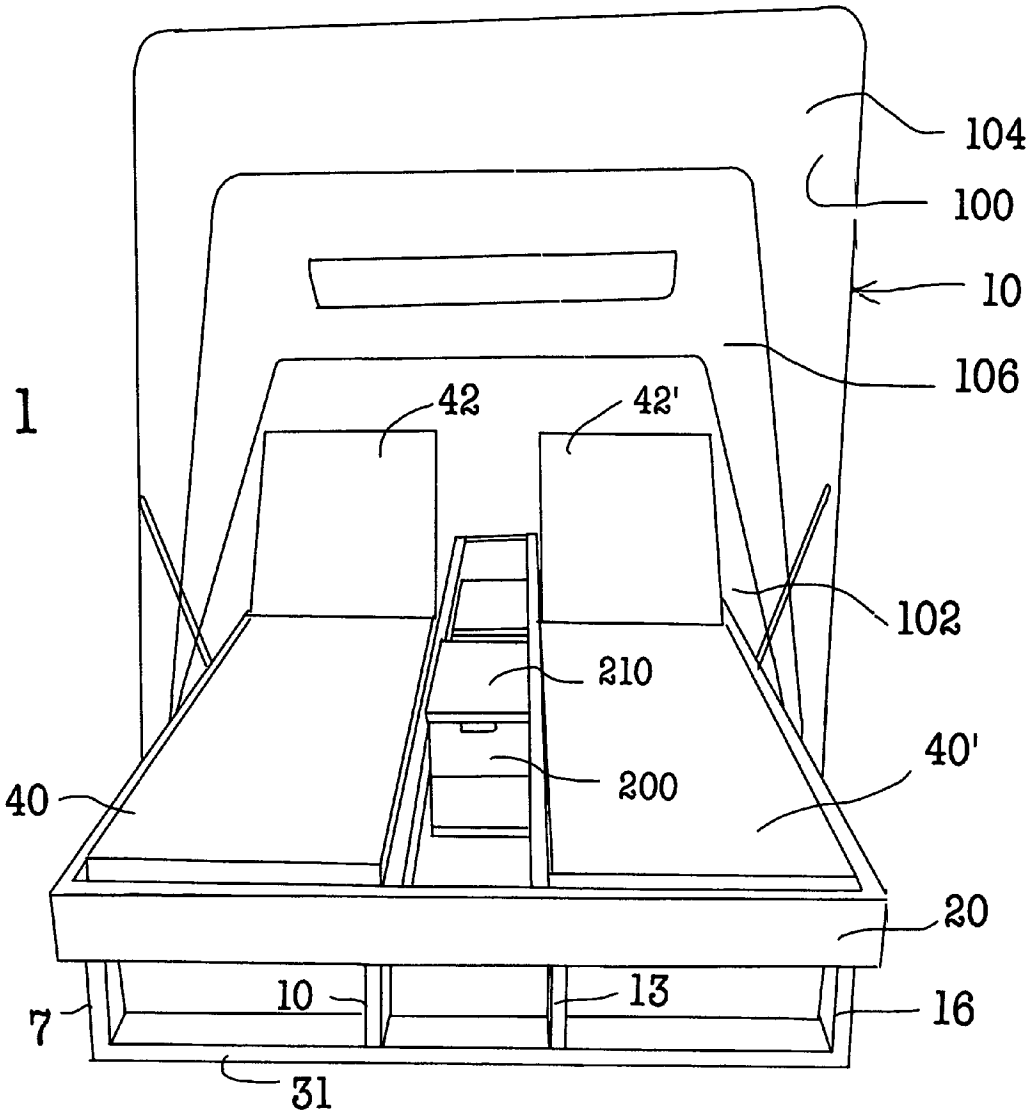
FIG. 1 is a perspective view of the adjustable folding cabana of the present invention having two spaced apart seats.

Referring first to FIG. 1, a perspective view of the cabana 10 is shown which shows the frame 20, a seat 40, second seat 40', legs 7, 10, 13 and 16 of the frame 20 and also a horizontal frame member 31. The seat 40 has a back portion 42 and a seat 40' has a back portion 42'. The cabana 10 includes a lockable storage cabinet 200 which includes a pivoting lid 210 which is attached with dampening hinges 212 to prevent injury from the lid rapidly closing. cabana fabric hood 100 is shown in a fully extended position which includes a rear hood end 102, a front hood end 104 and a middle hood portion 106.

Figure 2:
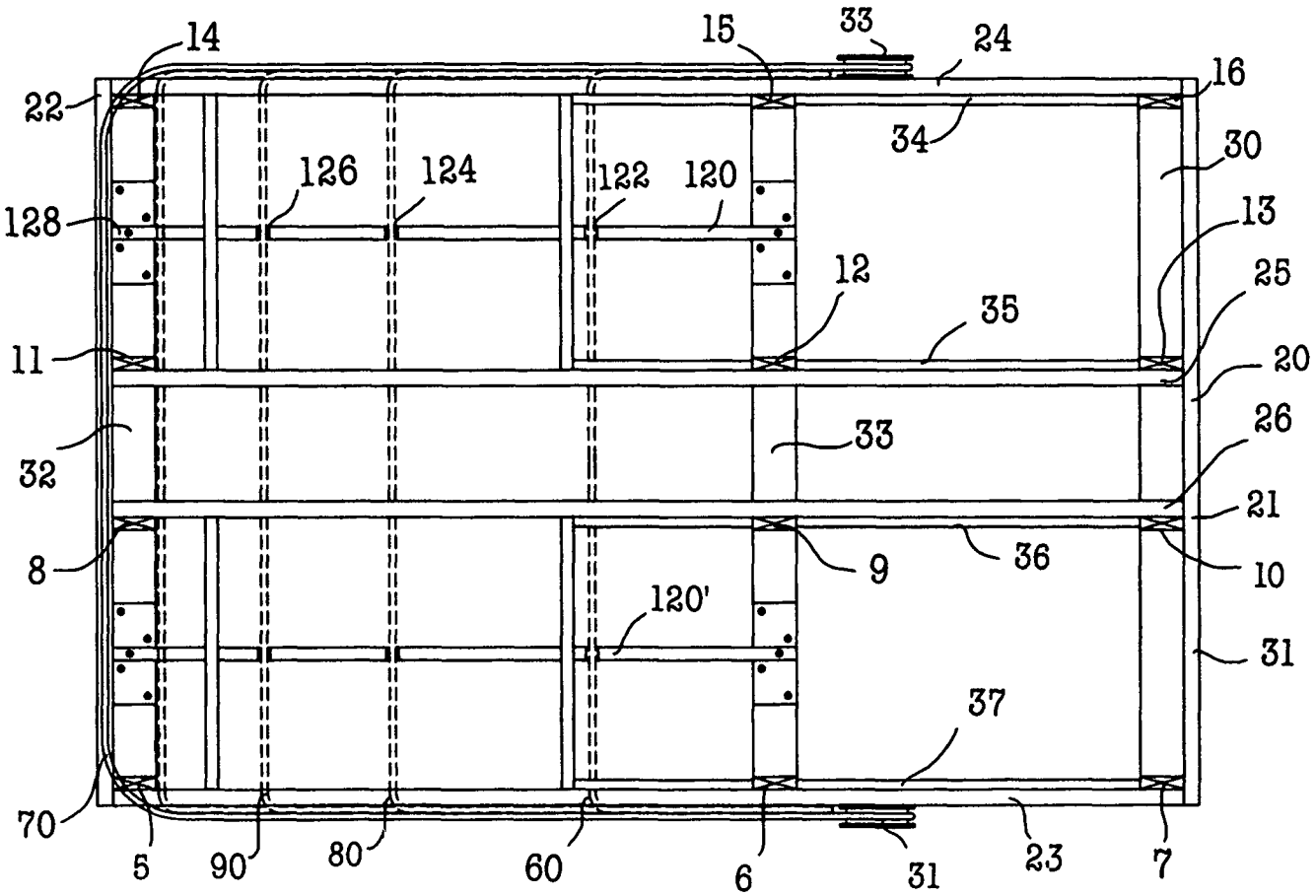
FIG. 2 is a top plan view of the frame of the adjustable folding cabana of FIG. 1 having the seats removed.

FIG. 2 is a top plan view showing the details of the many members of the frame. The various frame members are preferably fabricated from natural wood or a synthetic wood, but can be made of plastic. As can be seen, the frame member includes a number of frame elements which cause the frame to be relatively heavy and semi-permanent in nature making it extremely difficult for a single individual to quickly remove or steal the cabana from its desired placement location. Such a frame also provides a heavy mass which resists movement from wind catching the hood portion as will be explained in greater detail below. The frame 20 has a generally rectangular outer frame fabricated from end members 21 and 22 and from side members 23 and 24. A number of depending leg members 5, 6, 7, 8, 9, 10, 11, 12, 13, 14, 15 and 16 are provided to support the generally rectangular horizontal frame portion above ground level. The frame may include frame member 25 and 26 and two additional inner frame support members 35 and 36 may be utilized parallel to side members 23 and 24 to provide the basic support structure for two spaced apart seats. Inner frame support members 34 and 37 also are utilized for this purpose. It will be obvious to one of ordinary skill in the art that an embodiment of the invention which includes only one seat can be fabricated of the same basic design but for the elimination of inside frame members 25 and 26 and inside support members 35 and 36. A base plate 31 is provided beneath legs 7, 10, 16 and 25. A base plate 33 is provided beneath legs 6, 9, 12 and 15 and a base plate 32 is provided beneath legs 5, 8, 11, and 14. These base plates 31, 32 and 33 provide flat surfaces which prevent the cabana frame legs from sinking to deeply into sand or other soft material.

A pair of guide rails 120 and 120' are provided beneath the rectangular outer frame 21, 22, 23 and 24 and beneath the seats 40 and 40'. Guide rail 120 has a front stop 122, at least one intermediate stop 124 and 126 and a rear stop 128. Guide rail 120' has similar stops. Again it will be understood by one of ordinary skill in the art that a single guide rail 120 could be utilized but with a wider cabana which includes two spaced apart seats, a pair of guide rails 120 and 120' are preferred. FIG. 2 also shows the location of a connection point 31 on said frame to which various support members are mounted for rotation.

Figure 3:
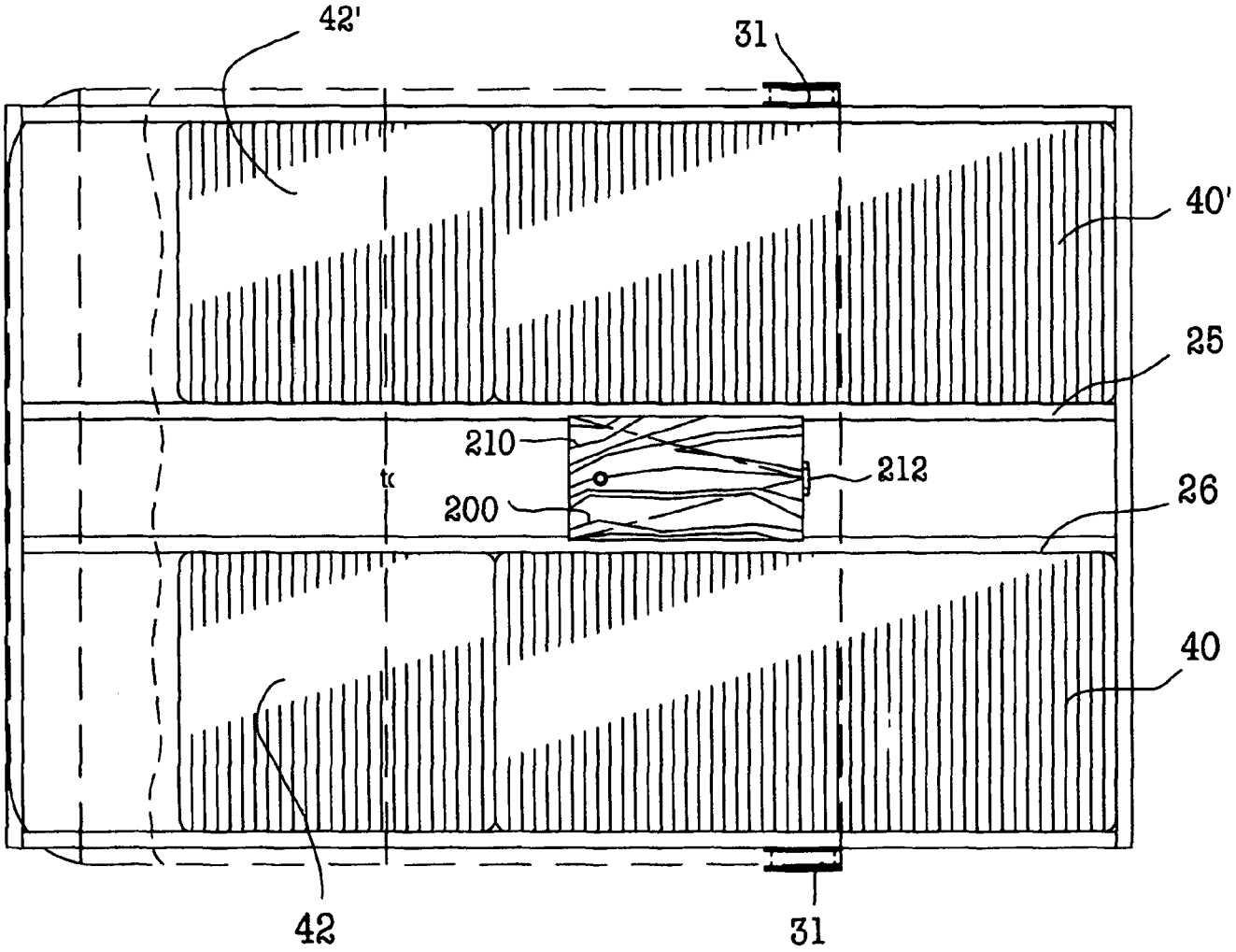
FIG. 3 is a top plan view of the adjustable folding cabana of FIG. 1.

FIG. 3 shows a top plan view of the cabana showing the seats 40 and 40' which have adjustable back rest portions 42 and 42', respectively. FIG. 3 also shows the lockable storage cabinet 200 including the pivoting lid 210 therefore with dampening hinges 212. The lockable storage cabinet 200 is securely mounted between the frame members 25 and 26 in a manner that it may not be easily removed from the frame. Because of the weight of the frame, objects stored within the lockable storage cabinet 200 can be secured against theft while one enters the water to swim or otherwise walks away from the cabana for any other reason.

Figure 4:
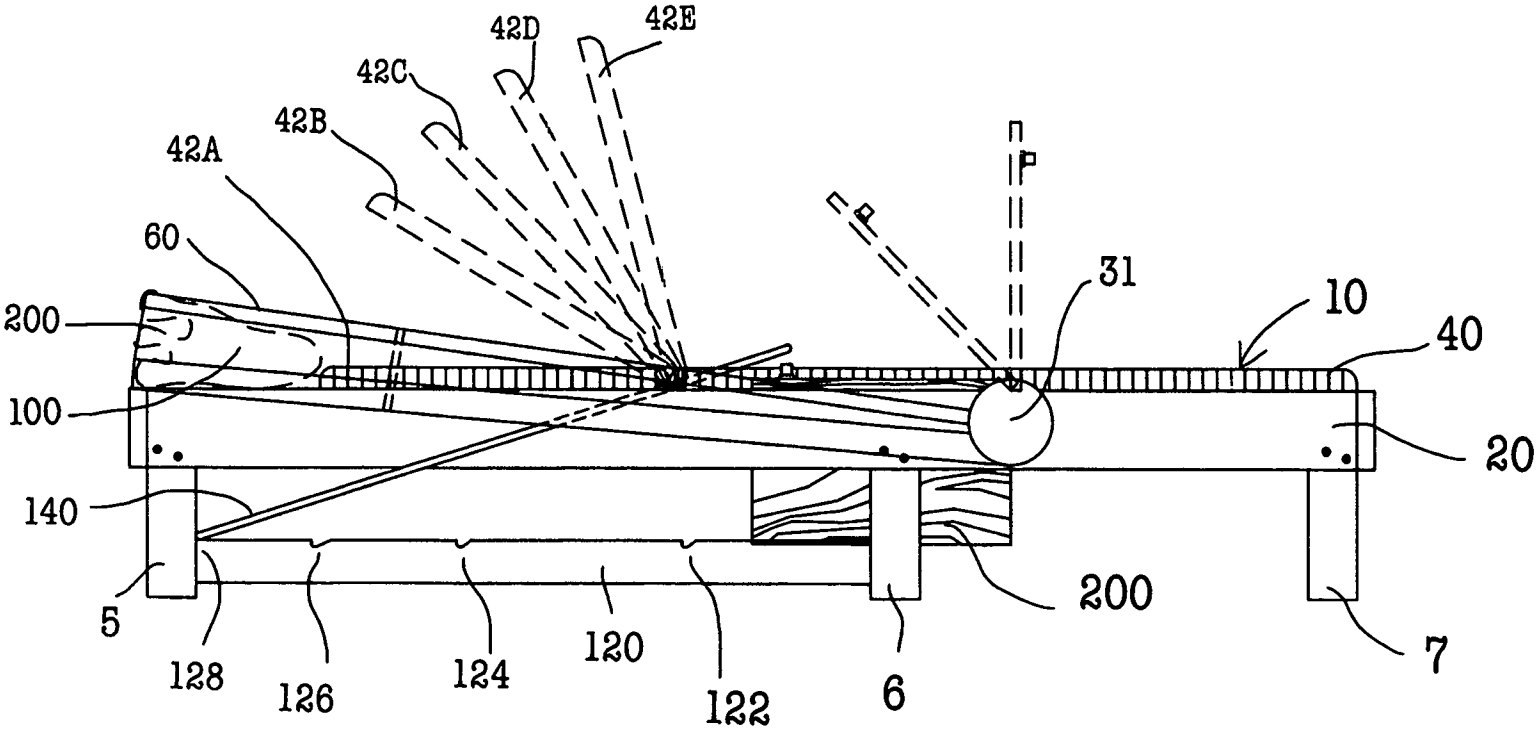
FIG. 4 is a side elevational view of the adjustable folding cabana of FIG. 1 with the cabana fabric hood in a fully collapsed position.

FIG. 4 shows a side view of the cabana 10 with the cabana fabric hood 100 in a fully collapsed no shade position 200. With the hood fully collapsed, so that the user receives no shade from the sun and has a fully unobstructed view of his or her surroundings. FIG. 4 shows a provision of a control rod 140 engaged against rear stop 128. Intermediate stops 124 and 126 are shown as is front stop 122. As will be described, these stops are utilized when the cabana fabric hood 100 is moved to different positions. As also shown in FIG. 4 the adjustable back rest 42 of seat 40 can be adjusted to a number of positions such as a fully flat position 42A, a number of intermediate positions 42B, 42C and 42D or to a fully upright seating position 42E.

Figure 5:
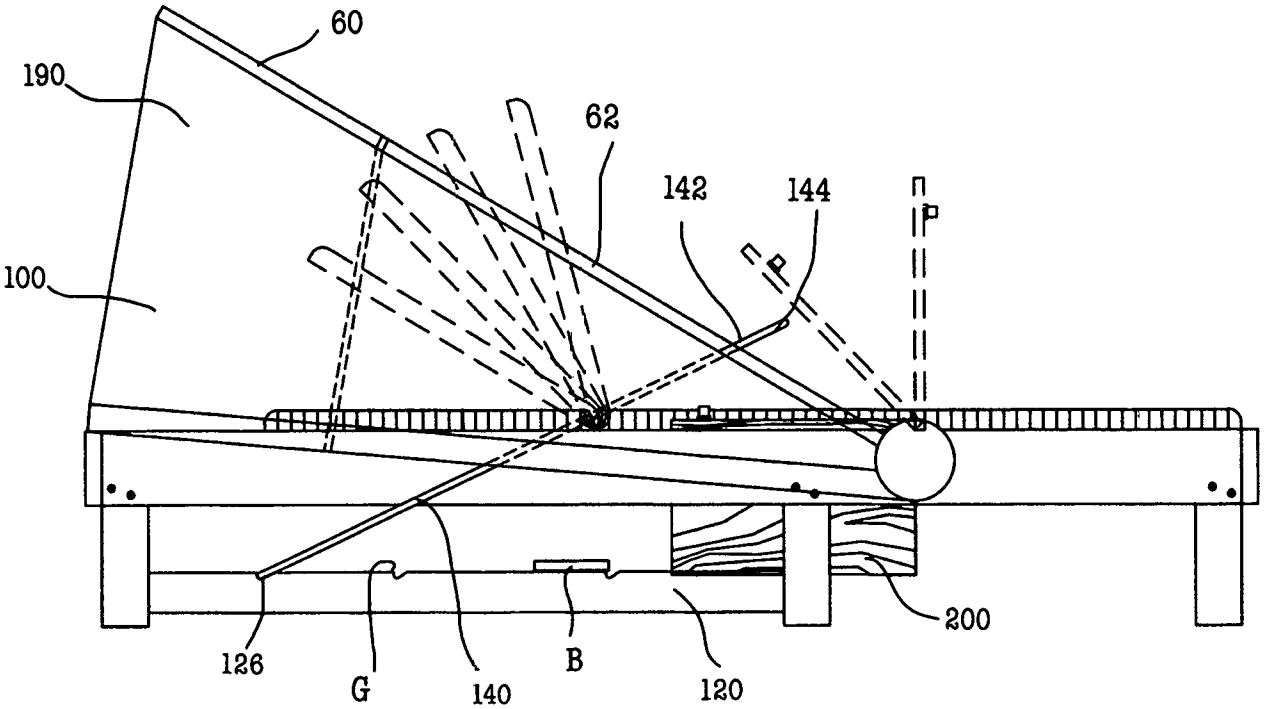
FIG. 5 is a side elevational view of the adjustable folding cabana of FIG. 1 with the cabana fabric hood in a first intermediate position.

FIG. 5 is a side elevational view similar to that of FIG. 4 but with the control rod 140 engaged in a first intermediate stop 126. In this position, the cabana hood 100 is in a first partial shade position 190. FIG. 5 shows a front support member 60 having legs 62 which are pivotally connected to the control rod 140 at pivotal connection point 142 and upright rod portion 144 which can be utilized as a handle to manipulate the control rod 140.

Figure 6:
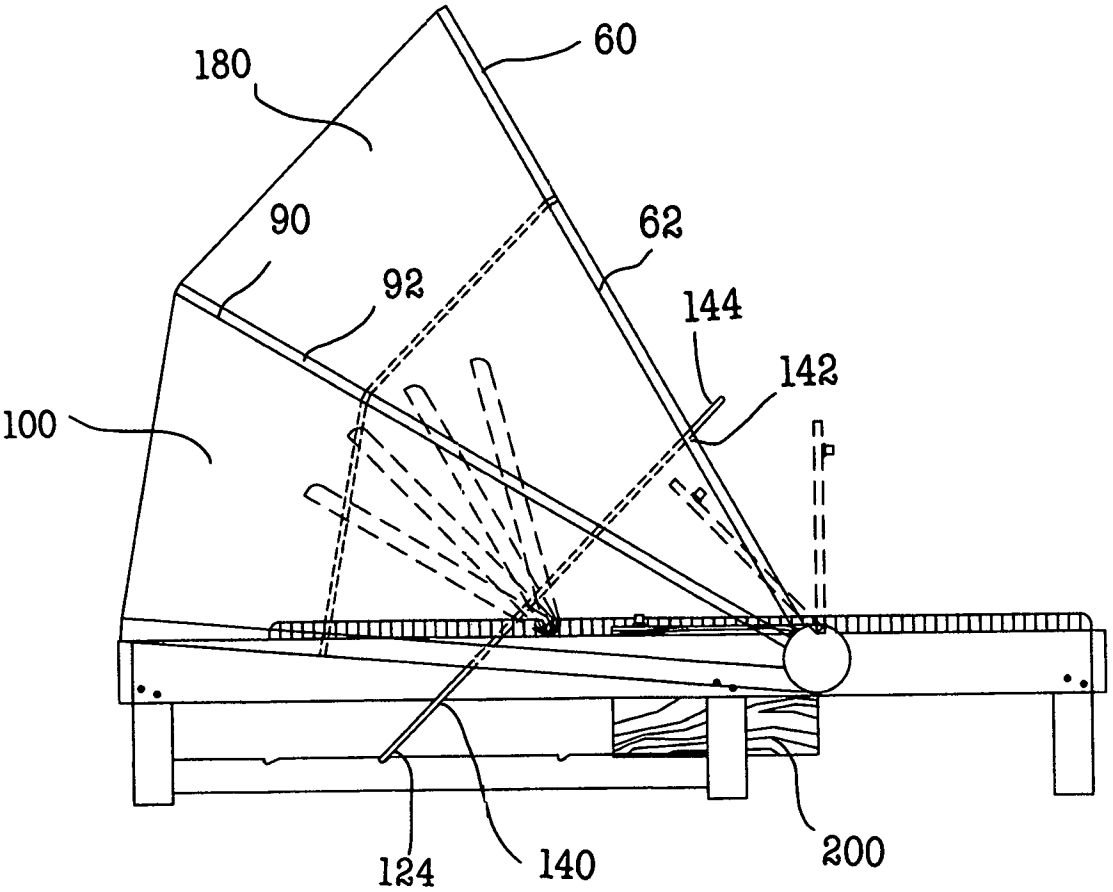
FIG. 6 is a side elevational view of the adjustable folding cabana of FIG. 1 with the cabana fabric hood in a second intermediate position.

FIG. 6 sows a side elevational view of the cabana 10 with the hood 100 in a second partial shade position 180 the control 140 engaged in stop 124. Front support member 60 and front support leg 62 as well as intermediate support member 90 and its leg portion 92 are shown.

Figure 7:
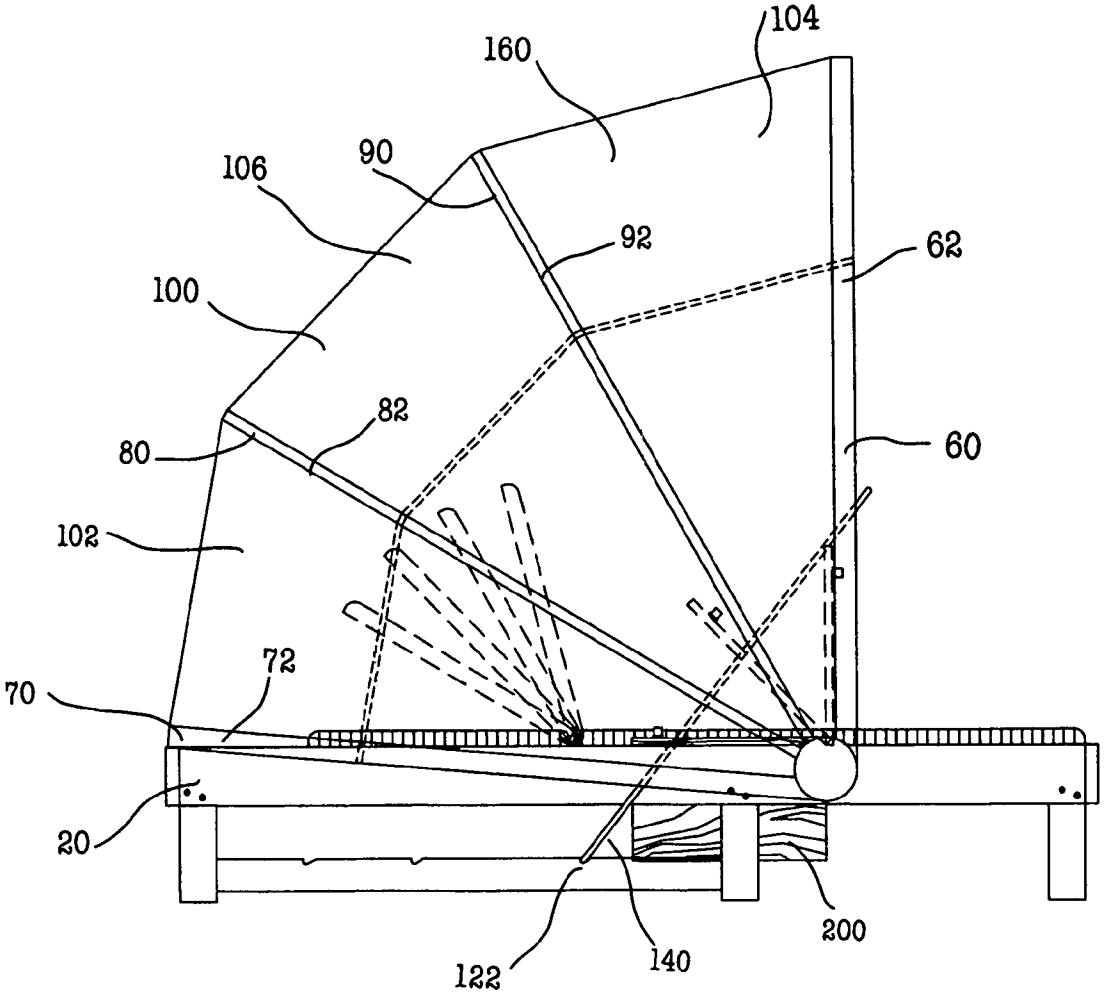
FIG. 7 is a side elevational view of the adjustable folding cabana of FIG. 1 with the cabana fabric hood in a fully extended position.

FIG. 7 is a side elevational view of the adjustable folding cabana 10 with the cabana fabric hood 100 in a fully extended full shade position 160. In this position 160 the legs 62 of the support member 60 are generally in a vertical position. The legs 92 of first intermediate support member 90, the legs 82 of second intermediate support member 80 and the legs 72 of rear support member 70 are shown in their various positions. The legs 72 over support member 70 are shown in a generally horizontal position. While the rear support member 70 attached to rear hood end 102 maybe in the form of a U-shaped member with legs 72, it will be obvious that the rear hood end could be attached directly to the frame 20 in which case the frame itself would act as the rear support member 70. In this full shade position 160, the control rod 140 is engaged in stop 122.

Figure 8:
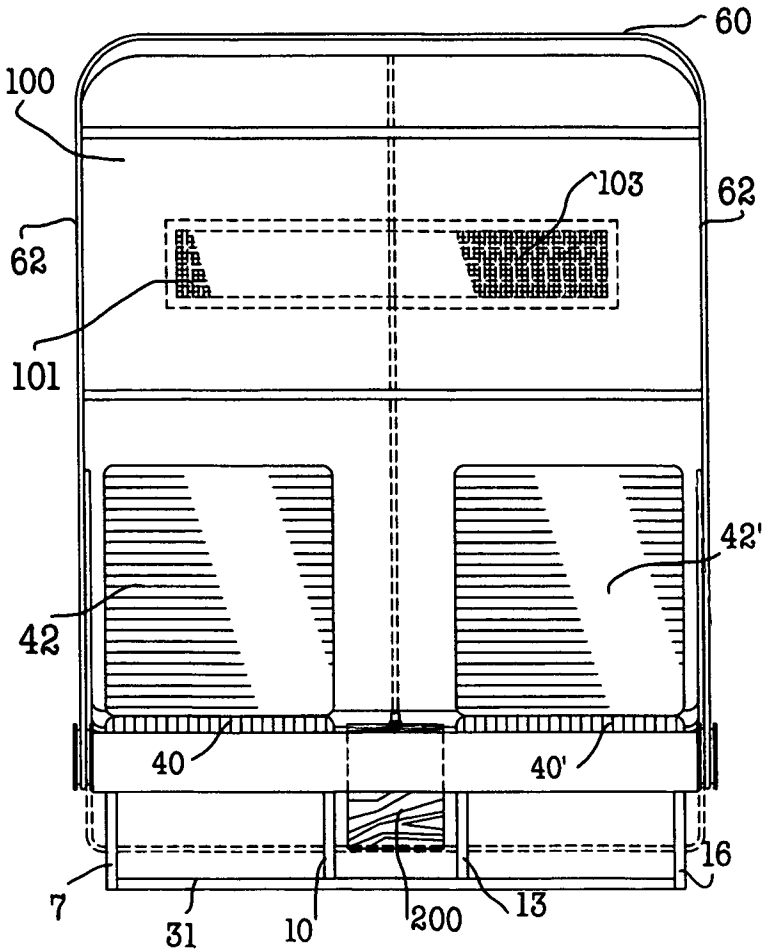
FIG. 8 is a front elevational view of the adjustable folding cabana of FIG. 1.

FIG. 8 shows a front elevational view of the cabana 10 with the front support member 60 having its legs 62 in a vertical position in the full shade position 160. In this view, it is shown that the fabric hood 100 may include a screened window 101 which may include a flap which can be zipped open and closed to allow some light to enter through the window 101. FIG. 8 also shows the location of seats 40 and 40' with the lockable storage container 200 secured between said seats.

Figure 9:
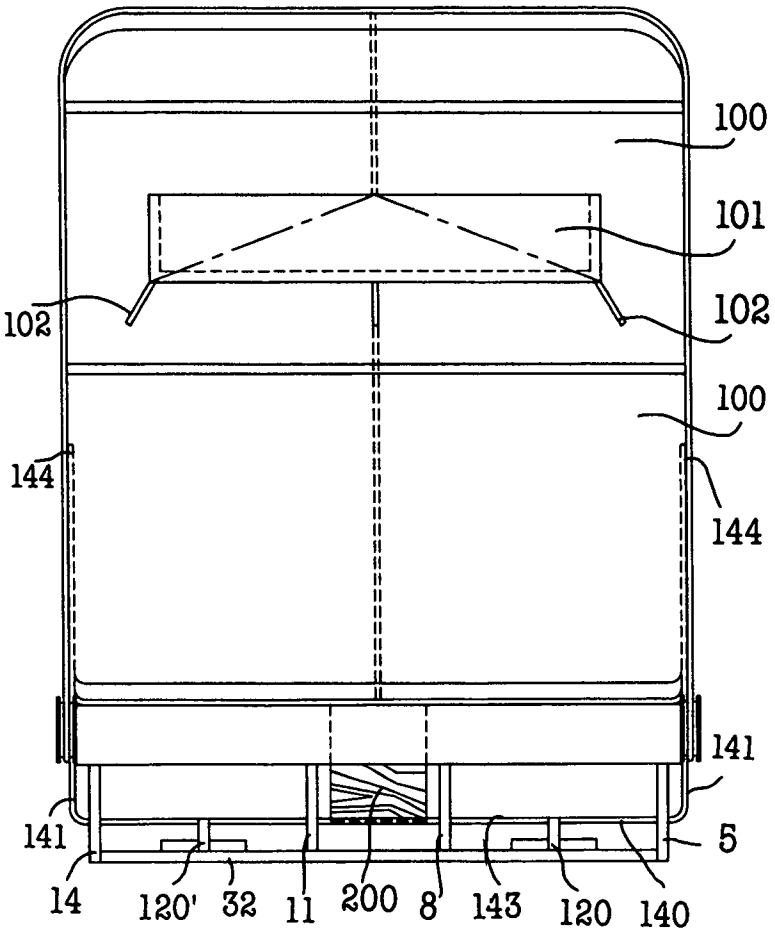
FIG. 9 is a rear elevational view of the adjustable folding cabana of FIG. 1.

FIG. 9 is a rear elevational view of the adjustable folding cabana 10 and shows the window 101 of fabric hood 100 with tabs 102 which may be utilized to zip or unzip the flap which covers the screened in area 103 as shown in FIG. 8. FIG. 9 also shows that the control rod 140 is preferably a U-shaped member which includes a horizontal portion 143 and upright control legs 141. Horizontal portion 143 of the control rod 140 is shown as engaged in the stops on guide rails 120 and 120'. Referring back briefly to FIG. 5, the stops in guide rail 120 may take the form of a groove G indented into the guide rail 120 or in the form of a block B attached to an upper surface of the guide rail 120. As can be seen, the user can manipulate the upper ends 144 of the U-shaped control rod 140 which pivots at locations 142 on the leg member 62 of front support member 60 whereby manipulating the control rod 140 causes the cabana fabric hood 100 to be fully extended (as shown in FIG. 7) when said rod 140 is secured in said front stop 22: to be partially collapsed when said control rod 140 is secured in intermediate stop 124 (as shown in FIG. 6); to be further but partially collapsed when said control rod 140 is secured in intermediate stop 124 (as shown in FIG. 5) and to be fully collapsed when said control rod 140 is secured in said rear stop 128 (as shown in FIG. 4). The rear stop 128 may actually be the location where the guide rail 120 is connected to the frame or it may consist of a groove or a block as in the case of the other stops. Since the cabana structure itself is quite large, while it is possible for a single individual to manipulate the upper end 144 of the control rod 140 to collapse or expand the cabana fabric hood 100, it is a lot easier for a pair of individuals to stand on opposite sides of the cabana and each grab a respective end 144 of the U-shaped control rod 140 to manipulate the rod into the desired stop corresponding with the amount of sun or shade which the users then desire.

Figure 10:
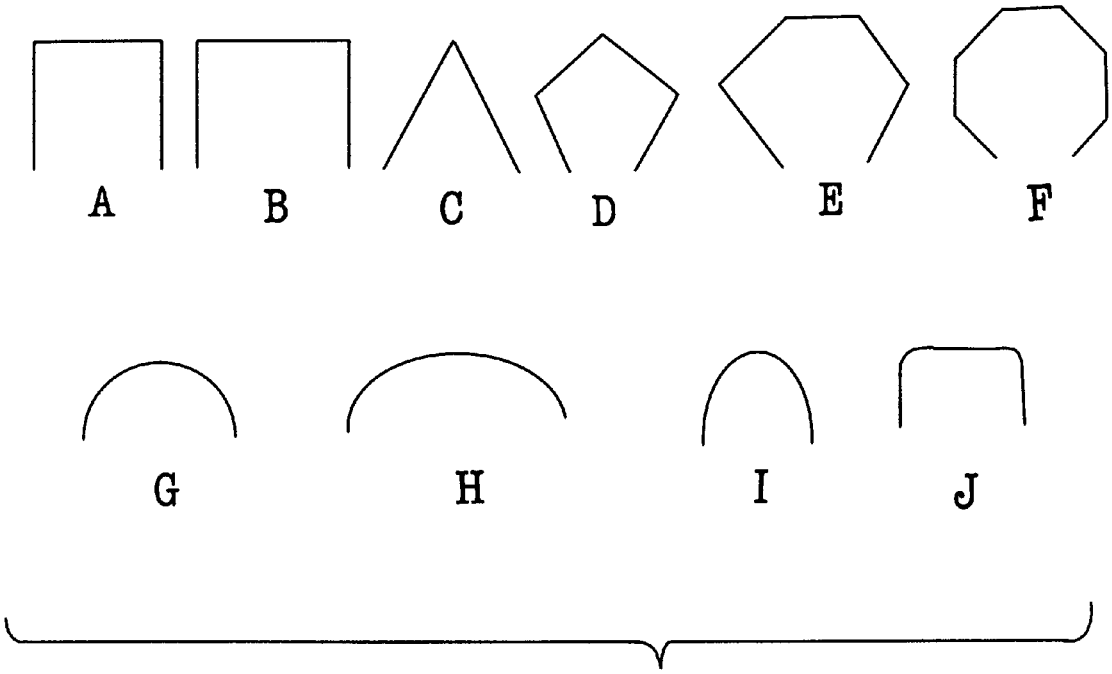
FIG. 10 is a view showing various possible shapes for the support members.

The support members 60, 70, 80, and 90 can have any two dimensional shape having an open bottom and having downwardly dependening leg portions to act as an arch or roof support for the cabana fabric hood 100. FIG. 10 shows some of the possible geometric configurations that the support members could take. FIG. 10A shows an open bottom square, FIG. 10B a rectangle, FIG. 10C a triangle, FIG. 10D a pentagon, FIG. 10E a hexagon, FIG. 10F an octagon, FIG. 10G a circle, FIG. 10H an oval, FIG. 10I an arch and FIG. 10J an inverted "U". Presently the inverted "U" as shown in FIG. 10J is preferred. The hood 100 of the folding cabana 10 is preferably formed of a water resistant material and also provides protection from ultraviolet rays from the sun.

The seats 40 and 40' may be formed out of any cloth or plastic material stretched between side members of the frame. Preferably the seat comprises a hard bottom cushion supported by the inside members of the frame 20. Support members 60, 70, 80, and 90 are preferably fabricated from a metal tubing material but may be made from any structurally strong tubing member such as plastic or carbon fiber.

In use, once the cabana is positioned in a desired location such as, for example, a beach overlooking the ocean or a lake, the cabana hood 100 can be easily expanded from the fully collapsed no shade position shown in FIG. 4 to the partially collapsed positions of FIGS. 5 and 6 or to a fully extended no shade position as shown in FIG. 7 by merely manipulating the control rod 140. This allows the user to control his or her environment by providing a desired amount of sun, light, shade, wind or other factors suitable to the location, time of day and weather conditions. Because of the construction of the frame and its weight and sturdiness, the user can be assured that the cabana cannot be easily stolen or removed from the site without considerable effort on the part of one desiring to do so. Also, the provision of a secure lock box is highly desirable in this modern age where users have money, credit cards, cell phones and other valuables which they wish to protect while they enter the water for swimming or otherwise leave their cabana location for any reason. While no security system can provide absolute protection, such a lockable storage container provides orders of magnitude greater protection than simply placing your valuables under a towel or near your chair at the beach. It is envisioned that the cabana of the present invention will be made out of top quality materials and craftsmanship such that it will be highly desirable in a variety of hotel or resort locations where guests desire to lounge in an outdoor location. While many individuals may also desire such a cabana for their own personal use at their homes or other property, it is envisioned that the cabana will also be highly desirable at various commercial vacation locations giving the user control over his or her environment when relaxing in an outdoor setting. The ability to make various adjustments to both the hood and the seat while providing security and safety will provide a highly relaxing and peaceful experience for the user.

It is to be understood that while certain forms of the present invention have been illustrated and described herein, the present invention is not to be limited to the specific forms or arrangements of parts described and shown.

I claim:

1. A cabana having an adjustable folding hood comprising:

a) a frame having legs attached to said frame to support said frame in an elevated horizontal position, said frame including a plurality of non-tubular frame elements formed of a solid material such as wood, synthetic wood or plastic, said frame having a heavy mass and being semi-permanent in nature whereby the heavy mass of the frame impedes theft and movement from wind gusts, said frame having an outer frame being generally rectangular in shape and having an inner frame to support at least one seat;

b) a seat supported on said inner frame, said seat having a back portion;

c) a front support member, a rear support member and at least one intermediate support member, said front support member and said at least one intermediate support member each support member having support member legs mounted for rotation at a connection point on said frame;

d) a cabana fabric hood having a rear hood end attached to said rear support member, a front hood end attached to said front support member and a middle hood portion attached to said at least one intermediate support member;

d) at least one guide rail attached to said legs of said frame whereby said at least one guide rail is in a lower elevated horizontal position spaced apart from said frame and located beneath said back portion of said seat, said at least one guide rail and having a front stop, at least one intermediate stop and a rear stop;

e) a U-shaped control rod, said control rod having a horizontal portion and a pair of control rod legs, said horizontal portion adapted to slide on said at least one guide rail and to be adjustably secured to one of said stops, said control rod legs being pivotally attached at pivotal connection points to said front support member, said pivotal connection points positioned a distance from ends of said control rod legs wherein upright rod portions extend upwardly from said pivotal connection points and comprise a pair of handles, whereby manipulating said control rod handles causes said cabana fabric to be fully extended when said control rod is secured in said front stop, to be partially collapsed when said control rod is secured one of said at least one intermediate stops, and to be fully collapsed when said control rod is secured in said rear stop.

2. A cabana according to claim 1 wherein causing the cabana hood to be fully extended creates a full shade position with said front support member in said front support position, said at least one intermediate support member in said at least one intermediate support position and said rear support member in a said rear support position.

3. A cabana according to claim 1 wherein causing the cabana hood to be partially collapsed creates a partial shade position with said front support member and said at least one intermediate support member all in said at least one intermediate support position and said rear support member is in a said rear support position.

4. A cabana according to claim 1 wherein causing the cabana hood to be fully collapsed creates a no shade position with said front support member, said at least one intermediate support member and rear support member all in said rear support position.

5. A cabana according to claim 1 wherein said frame is generally rectangular in shape and has an inner frame to support one seat.

6. A cabana according to claim 1 wherein said frame is generally rectangular in shape and has a modified inner frame to support two spaced-apart seats.

7. A cabana according to claim 6 further comprising a lockable storage cabinet strongly secured between said spaced-apart seats.

8. A cabana according to claim 7 wherein said storage cabinet has a pivoting lid attached with dampening hinges to prevent injury from the lid rapidly closing.

9. A cabana according to claim 1 wherein said at least one intermediate support member comprises a single first intermediate support member and said at least one intermediate support position comprises a single first intermediate support position.

10. A cabana according to claim 1 wherein said at least one intermediate support member comprises a first intermediate support member and a second intermediate support member and said at least one intermediate support position comprises a first intermediate support position and a second intermediate support position.

11. A cabana according to claim 1 wherein said seat comprises a cloth or plastic material provided between side members of said frame.

12. A cabana according to claim 1 wherein said seat further comprises an adjustable back rest which can be locked into a plurality of positions between a fully flat position and a fully upright sitting position.

13. A cabana according to claim 1 wherein said rear support member is said frame.

14. A cabana according to claim 1 wherein said support members can have any two dimensional shape having an open bottom and having downwardly depending leg portions to act as an arch or roof support for said cabana fabric.

15. A cabana according to claim 14 wherein said support members have a general bottom open shape selected from the group comprising a square, rectangle, a triangle, a pentagon, a hexagon, an octagon, a circle, an oval, an inverted "U" and an arch.

16. A cabana according to claim 1 wherein said stops are in the form of a groove cut into said at least one guide rail at selected locations.

17. A cabana according to claim 1 wherein said stops are in the form of blocks attached to an upper surface of said at least one guide rail at selected locations.

18. A cabana according to claim 1 wherein said cabana hood is water resistant and provides protection from ultraviolet rays from the sun.

19. A cabana according to claim 1 wherein said at least one guide rail further comprises a pair of parallel spaced-apart guide rails each located in the same lower elevated horizontal position.

* * * * *